US005102522A

United States Patent [19]

Rivers

[11] Patent Number: 5,102,522

[45] Date of Patent: Apr. 7, 1992

[54] METAL RECOVERY APPARATUS

[76] Inventor: James Rivers, P.O. Box 1015, Oak Ridge, Tenn. 37830

[21] Appl. No.: 625,298

[22] Filed: Dec. 10, 1990

[51] Int. Cl.[5] ..... C25C 7/00

[52] U.S. Cl. ..... 204/237; 204/272; 204/273; 204/275

[58] Field of Search ..... 204/272, 273, 275, 109, 204/237

[56] References Cited

U.S. PATENT DOCUMENTS

| | | | |
|---|---|---|---|
| 3,003,942 | 10/1961 | Cedrone et al. | 204/272 |
| 3,694,341 | 9/1972 | Luck, Jr. | 204/109 X |
| 3,702,814 | 11/1972 | Mandroian | 204/237 |
| 3,715,299 | 2/1973 | Anderson et al. | 204/109 X |
| 3,925,184 | 12/1975 | Cave | 204/109 X |
| 4,026,784 | 5/1977 | Rivers | 204/273 |
| 4,028,212 | 6/1977 | Bowen et al. | 204/109 X |
| 4,069,127 | 1/1978 | Salemi et al. | 204/229 |
| 4,149,954 | 4/1979 | Ransbottom | 204/272 |
| 4,367,127 | 1/1983 | Messing et al. | 204/109 X |
| 4,372,829 | 2/1983 | Cox | 204/109 |
| 4,439,300 | 3/1984 | Houseman | 204/272 |
| 4,440,616 | 4/1984 | Houseman | 204/272 |
| 4,675,085 | 6/1987 | Vasquez | 204/105 |
| 5,017,273 | 5/1991 | Woog | 204/109 X |

FOREIGN PATENT DOCUMENTS 916438 1/1963 United Kingdom .

*Primary Examiner*—Donald R. Valentine

*Attorney, Agent, or Firm*—Luedeka, Hodges, Neely & Graham

[57] ABSTRACT

An apparatus for the electrolytic recovery of metals from liquid solutions containing recoverable metal values. The apparatus comprises a housing containing a tubular cathode concentrically disposed about and radially spaced from an elongated anode for defining a solution-containing volume there-between. An elongated tubular baffle means having a plurality of thoroughgoing perforations through the side wall thereof and along the longitudinal length thereof is disposed about a substantial length of the anode and is in registry with the inlet to a solution pumping means located within the housing that is utilized for circulating the solution in a helical flow pattern within the housing volume. As the solution is circulated by the pumping means, a substantial volume of the solution passes into the baffle means through its open end and through the perforations so that the presence of the baffle means inhibits the formation of vortices in the circulating solution and provides for uniform solution distribution within the volume to assure the presence of metal at the cathode even during relatively low concentrations of the metal in the solution. The housing is supported on a base containing the drive means for the pumping means in such a manner that it can be readily removed from the base for facilitating the removal of the collected metal from the cathode.

20 Claims, 2 Drawing Sheets

METAL RECOVERY APPARATUS

BACKGROUND OF THE INVENTION

The present invention relates generally to the recovery of metal values from liquid solutions by employing electrolytic metal separation apparatus, and more particularly to an improved metal recovery system for effecting such electrolytic separation and the recovery of the separated metal values.

The electrolytic recovery of ionized metal values from metal-containing liquid solutions such as silver in photographic and radiographic film processing solutions has been achieved in metal recovery apparatus using well known electrolytic separation practices. In such recovery practices an electric current flowing between an anode and cathode through a metal-laden solution ionizes metal values in the solution and effects deposition of the metal ions in the solution onto the cathode for subsequent recovery.

A type of metal recovery system which has been found to be successful utilizes a cathode in a cylindrical form with an elongated anode disposed within the cathode along the longitudinal axis thereof. A metal-containing solution is circulated through the chamber defined between the anode and cathode while an electric current is established between the anode and cathode through the solution to effect the deposition ionized metal values in the solution onto the cathode. One such system of this type is described in patentee's U.S. Pat. No. 4,026,784 which issued May 31, 1977. In this patented system the metal-laden liquid solution is circulated by an external pump throughout the vertically oriented chamber between the cathode and anode along a generally helical flow path adjacent to the vertical cathode walls. This helical flow pattern exposes metal ions in the liquid solution to a substantial area of the cathode walls to thereby provide an efficient metal recovery operation. This patented system also utilizes a current control mechanism for providing preselected current densities at the cathode for enhancing the rate of metal recovery as well as increasing the quantity of metal recoverable from the solution. For example, in a silver recovery operation, a high cathode current density is used to provide a maximum deposition rate for the metal into the cathode while sufficient silver ions are in the solution to prevent the occurrence of undesirable sulfiding. However, when the liquid solutions become sufficiently depleted of silver so as to contain an insufficient concentration of silver to inhibit sulfiding, a lower cathode density is then used to provide additional silver recovery. In as much as features in this patented system correspond generally to or are similar to features useful in the practive of the present invention, the aforementioned patent is incorporated herein by reference.

While metal recovery systems, such as described in the aforementioned patent, provide satisfactory levels of metal recovery from metal-containing solutions such as silver from photographic and radiographic film processing solutions, there were found to be some shortcomings or drawbacks which detracted from the overall efficiency and desirability of these previously known systems. For example, when utilizing a helical flow pattern for the metal containing solution, it was discovered that vortices were formed in the circulating solution at locations in the chamber intermediate the anode and the cathode with such vortices producing dead spots in the solution with zero rotational direction. With these vortices introduced into the circulating solution, a significant amount of the metal contained in the solution tends to precipitate out of the solution and collect in the center of the vortices so as to substantially reduce the percentage of metal in the solution that is collectable at the cathode. Another shortcoming found to be attendant with such previously known metal recovery systems is that the removal of the accumulated metal on the cathode often involved considerable disassembly of the system so as to result in a substantial expenditure of labor and downtime for effecting the actual recovery of the metal removed from the metal-containing solution.

SUMMARY OF THE INVENTION

Accordingly, an object of the present invention is to provide a metal recovery assembly or apparatus which obviates or substantially minimizes problems or other shortcomings such as described above that are associated with the operation of previously known metal recovery systems. The present invention obviates or significantly reduces the formation of the undesirable vortices which heretofore occurred in metal-containing solutions subject to spiral or helical flow patterns within the metal recovery unit. Generally, the present invention achieves this objective in an improved metal recovery system having an electrolytic cell for separating and collecting metal from a metal-containing solution. This metal recovery system comprises a housing means; an elongated tubular cathode means disposed within the housing means; an elongated anode means disposed within the housing means at a location radially inwardly spaced from the cathode means; pump means for circulating a metal-containing solution within the housing means along a helical flow path; and elongated baffle means disposed intermediate the anode means and the cathode means and contactable by the circulating metal-containing solution for inhibiting formation of vortices in the circulating solution.

The baffle means is of an annular configuration and is disposed about the elongated anode means over a substantial length thereof so as to define an open-ended annular passageway therebetween. The baffle means is provided with a plurality of thoroughgoing, solution-receiving bores or perforations at locations on its side wall intermediate opposite ends thereof. The pump means is located within the housing and has inlet means in registry with the annular passageway at one end of the baffle means for drawing metal-containing solution there into through both the open end of the annular passageway and the side wall perforations. The pump means also has elongated outlet means disposed in said housing means for discharging into the housing metal-containing solution received in the pump means through the inlet means. This outlet means is inclined at a angle sufficient to cause the metal-containing solution discharging therefrom to flow along a helical flow path throughout the longitudinal length of the housing and in close proximity to the cathode means.

The present invention provides the perforated hollow cylindrical baffle means which is supported at one end thereof in the housing at a location therein that is coaxially aligned with the pump inlet means and is disposed concentrically about a substantial length of the anode in a spaced relationship thereto. The perforated baffle means contacts and receives therein, through the open end thereof surrounding the anode and through the perforations therein the solution to be circulated within the housing by the pump means. The contacting of the baffle means by the helical flow of solution and the bleeding-off of a portion of the solution through the perforations in the baffle means inhibits the formation of vortices within the circulating solution. Importantly, the baffle design ensures that the central anode is at all relevant times fully contacted by the metal-containing solution, thereby ensuring uniformity and continuity of the desired current density within the solution.

Another object of the present invention is to provide for uniform distribution of the metal within the solution by employing the perforated baffle means which assures the presence of metal at the cathode and provides for deposition of metal onto the cathode when the metal is in relatively low concentrations within the solution.

A further object of the present invention is to provide a metal recovery system wherein the housing containing the cathode and anode therein may be readily separated from a base assembly and the drive means for the solution pumping means to facilitate the recovery of the metal from the cathode and increase the overall operational efficiency of the metal recovery system.

A still further object of the present invention is to provide an electrolytic metal recovery assembly wherein the housing, elongated tubular cathode and anode may be utilized in a metal recovery operation while disposed in a horizontal orientation.

Other and further objects of the present invention will become obvious upon an understanding of the illustrative embodiment about to be described or will be indicated in the appended claims, and various advantages not referred to herein will occur to one skilled in the art upon employment of the invention in practice.

DETAILED DESCRIPTION OF THE INVENTION

Figure 1:
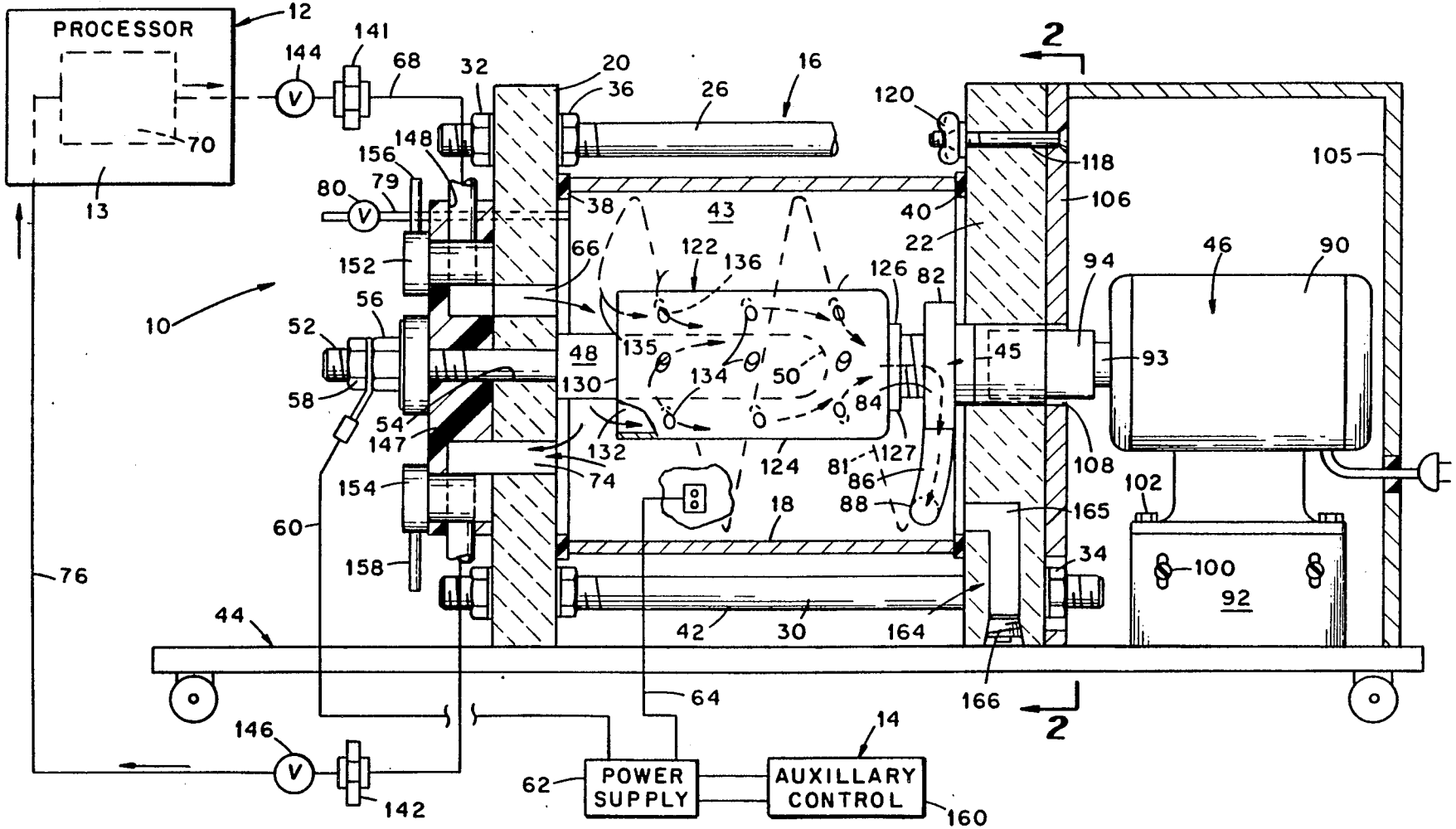
FIG. 1 is a longitudinal cross-sectional view of one embodiment of an electrolytic metal recovery assembly depicting various features of the present invention.

The apparatus 10 illustrated in the drawings provides for the electrolytic recovery of metals from plating solutions, photographic and radiographic film processing solutions, and like liquid solutions containing electrolytically recoverable metal values. As shown in the drawings and as described in patentee's aforementioned patent, the apparatus 10 of the present invention is preferably utilized in combination with a photographic or radiographic film processor 12 in which a tank as generally shown at 13 holds the liquid film processing solution containing recoverable silver. However, it is to be understood that the present invention may be readily used to process any liquid solution containing electrolytically recoverable metal values in a continuous manner, such as with a film processor 12, or in a batch-type operation wherein the liquid solution to be treated is batch loaded into the metal recovery apparatus 10. Further, the apparatus 10 of the present invention is preferably coupled to an auxiliary current control mechanism 14 which, as described in patentee's aforementioned patent is used for providing selective current densities at the cathode of the electrolytic recovery apparatus 10 for increasing metal recovery efficiency particularly in the case of silver due to the problems associated with sulfiding.

The electrolytic metal recovery apparatus 10 includes a metal recovery unit or assembly 16 constructed in a manner substantially similar to that described in patentee's aforementioned patent. A tubular or cylindrical cathode 18 formed of a suitable material such as stainless steel which is electrically conductive and essentially inert to the corrosive agents used in film processing and plating solutions. The cathode is provided with a smooth interior wall surface for receiving a coating of electrolytically deposited metal thereon. End plates or covers 20 and 22 are located at opposite longitudinal ends of the cylindrical cathode 18. These covers 20 and 22 are of a rectangular configuration and are attached to each end of the cathode 18 by a suitable bolting arrangement such as bolts 24, 26, 28, and 30 extending through each corner of the rectangular covers at locations outside of the cylindrical cathode 18. These bolts pass through suitable bore holes in each cover and extend between the covers 20 and 22 along a plane parallel to the longitudinal axis to the cathode 18. Nuts such as shown at 32 and 34 threadably engage the bolts 24, 26, 28, and 30 to pull the covers 20 and 22 towards one another and against the end surfaces of the cathode 18. Nuts 36 on the inside of the cover 20, are utilized as a spacing mechanism to provide for uniformly spacing the covers 20 and 22 from one another to assure that the covers uniformly bear against the end surfaces of the cathode 18. The cover 20, as shown, is removable to provide access to the cathode 18 for permitting the removal thereof from the assembly 16 for the separation of the metal values received thereon. Such separation may be achieved by simply tapping or vibrating the cathode 18 to dislodge metal values from the cathode. The cathode 18 may then be replaced between the covers 20 and 22 by utilizing the bolting arrangement. Each of the end covers 20 and 22 are formed of a rigid, non-electrically conductive and chemically inert material such as a polyvinyl chloride or clear acrylic plastic. The interior surfaces of the end covers 20 and 22 bearing against the ends of the cathode are preferably placed in contact with suitable annular seals 38 and 40 positionable between end surfaces of the cathode 18 and the covers 20 and 22 so as to provide a liquid tight seal at the junctures between the cathode 18 and the covers 20 and 22.

The cathode 18 with the covers 20 and 22 attached thereto form a container or housing 42 having a liquid-containing volume 43 therein. This housing 42, as shown, is supported on a horizontal support structure or base 44 with the housing 42 so positioned that the cathode 18 is disposed in a horizontal orientation rather than in an upright orientation as previously utilized in metal recovery operations such as described in patentee's aforementioned patent. The horizontal positioning of the housing 42 on the base 44 facilitates the removal of the housing 42 from the base 44 and the alignment of the solution circulating pump means 45 within the housing 42 with the externally located pump drive means 46 as will be described below. However, while the housing 42 is shown horizontally mounted on the base 44, it will appear clear that the support structure or base 44 along with the positioning of the pump drive means 46 thereon may be readily modified so that the housing 42 and the cathode 18 therein are vertically oriented during metal recovery operations.

The housing 42 is provided with an elongated cylindrical anode 48 located at the circumferential center of the housing 42 with the anode attached to and longitudinally extending from the cover 20 towards the cover 22 to a location where the distal end 50 of the anode 48 is near to but longitudinally spaced from the cover 22. The distal end 50 of the anode 48 may be squared-off or rounded as shown. The anode 48 can be satisfactorily attached to the cover 20 at the center thereof by providing the proximal end of the anode 48 with a threaded shaft 52 which extends through a bore 54 in the cover 20 and is attached to the cover 20 by a suitable nut 56. An additional nut 58 is attached to the threaded shaft 52 for electrically coupling a lead 60 from a power supply 62 to the anode 48. The anode 48 may be satisfactorily fabricated from an electrically conductive material such as titanium coated with a suitable material such as platinum or other metal which is not subject to corrosion by solutions utilized in photographic and radiographic film processing operations. The cathode 18 is also coupled to the power supply 62 by the lead 64 to complete the electrical circuit.

For metal recovery purposes in accordance with the present invention, the housing 42 may be constructed in any suitable dimensions. For example, satisfactory results have been achieved by using a housing 42 wherein the cathode 18 is of a longitudinal length of about 6 inches and a diameter of about 8 inches and wherein the anode 48 is of a diameter of about 1 inch and cantileveredly extends from the cover 20 a distance of approximately 4.5 inches into the housing volume 43.

As shown in FIG. 1, the cover 20 is provided with a thoroughgoing bore for forming an inlet 66 through which a metal-containing solution such as from the film processor 12 can be introduced into the housing volume 43. To provide the flow of liquid solution from the processor 12 to the housing volume 43 a conduit 68 connects a pump 70 in the processor 12 to the inlet 66. This inlet 66 is preferably at a location in the cover near the longitudinal axis of the housing 42 so that liquid solution being introduced into the volume 43 flows directly onto the anode 48 for assuring desirable circulation of the metal-containing solution through the volume 43 by the pump 45 as will be described below. An outlet 74 is provided in the housing 42 for the solution from the volume 43 after metal values have been stripped therefrom by the electrolytic process. This outlet 74 is provided by another bore in the cover 20 at a location spaced a greater distance from the longitudinal axis than that of the inlet 66 so as to assure that the solution withdrawn from the volume 43 is that which has been substantially reduced in metal values by the electrolytic metal recovery process. The outlet 74 is coupled by a conduit 76 to the inlet of pump 70 in the processor 12.

In accordance with the present invention, the housing volume 43 is filled with liquid solution containing metal values prior to initiating the stripping of the metal values by the electrolytic process. During the filling of the volume 43 with the liquid solution whether the filling is achieved with solution from the processor 12 or from a source used in batch-type operations, a vent is preferably disposed in the housing 42 at an uppermost location such as generally shown in FIG. 1 with this vent being provided by a stem 79 which extends through the cover 20 and has check valve 80 thereon. By using a suitable vent, the housing volume 43 may be readily filled with the liquid solution without encountering undesirable pressure buildups or creating voids in the volume 43 such as caused by the presence of gases in the volume 43 which have not been vented to atmosphere during the charging of the volume 43 with liquid solution.

The rate at which the metal is electrolytically removed from the liquid solution is enhanced in accordance with the teachings in patentee's aforementioned patent by utilizing a helically flow pattern for the liquid solution within the volume 43 as generally shown by the arrows 81. This helical flow pattern causes the solution to be propelled along a path substantially following the curvature of the inner cylindrical wall of the cathode 18.

In the present invention the helical flow of liquid solution is achieved by employing a recirculating pump 82 attached to the inside surface of cover 22 by any suitable attaching arrangement such as bolts or the like (not shown). The pump 82 and the impeller 83 therein are constructed of a non-electrically conducting material that is not corroded by processing solutions such as provided by nylon, polyvinyl chloride, or any other polymeric material which has sufficient integrity to withstand the pumping operation. The liquid solution to be circulated within the volume 43 is received in the pump 82 through a centrally located inlet 84 and discharged into the volume 43 through a elongated outlet tube 86 having a discharge or outlet opening 88 at the distal end thereof. As shown in the drawings, the outlet tube 86 for use in a housing of the aforementioned size is of about 0.5 inch in diameter and projects tangentially from the pump 82 at an angle to the radius of the cathode 18 so that the outlet 88 is near the inner surface of the cathode 18. The tube 86 also has the outlet 88 at the end thereof inclined at an angle of about 40 to 50 degrees to the longitudinal axis of the cathode 18 so that the liquid solution being discharged from the pump 82 will be directed along a selected helically flow path within the valve 43. While the helically flow path of the solution as generally shown by the arrows 81 in FIG. 1 indicates that the solution undergoes approximately three revolutions during the longitudinal travel thereof through the volume 43, it will appear clear that this showing is merely for purposes of illustration and that several more revolutions of the solution would preferably be utilized during its travel through the housing volume 43.

The pump drive means 46 is provided by an electric motor 90 attached by a support 92 to the base 44. The shaft 93 of the motor 90 engages the impeller 83 of the pump 82 by using any suitable coupling 94 through a bore 96 centrally located in the cover 22. Preferably, the coupling 94 is achieved by using a magnetic drive such as described in U.S. Pat. No. 4,440,616 to Houseman. By employing a magnetic coupling, the driving of the pump may be achieved without encountering problems due to the presence of an inadequate sealing arrangement between the drive shaft 93 and the cover 22. However, if a suitable seal between the rotatable drive shaft 93 and the cover 22 can be provided, the shaft 93 may be coupled to the pump impeller 83 by any suitable readily engagable-disengagable non-electrically conducting coupling. The drive motor 90 is preferably supported on motor support 92 in such a manner as to be readily vertically and longitudinally adjustable such as by using bolts 100 for the vertical adjustment and the bolt arrangement 102 for longitudinal adjustments to assure alignment of the motor drive shaft 93 with the pump 82.

Figure 2:
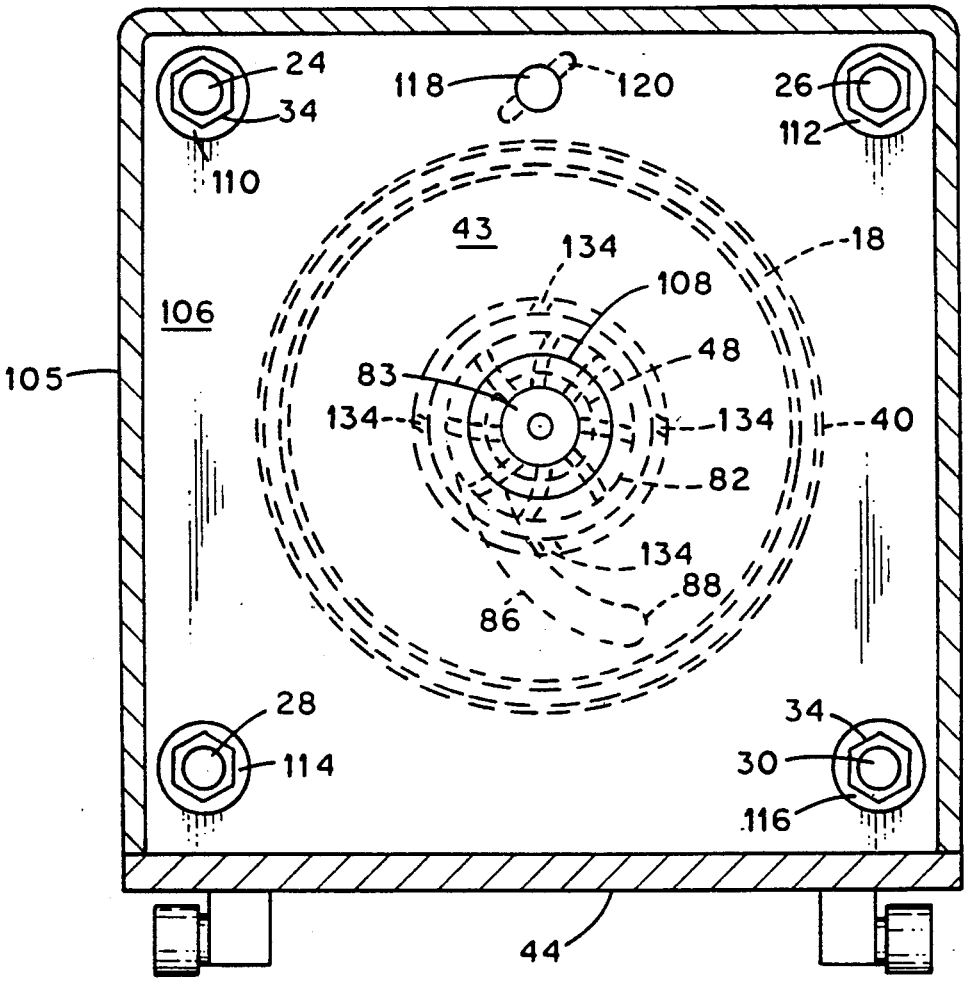
FIG. 2 is an end view taken along lines 2—2 in FIG. 1 showing further details of the depicted metal recovery assembly of the present invention.

The housing 42 is supported on the base 44 in alignment with the pump motor 90 by employing a motor-containing housing or casing 105 which includes a vertically extending wall or plate 106. As best shown in FIG. 2, the vertically extending plate 106 is provided with a centrally located bore 108 for receiving the pump drive and with corner bores 110, 112, 114, and 116 for receiving the bolts 24, 26, 28 and 30 and nuts 34 of the housing 42. As shown, the bores 110, 112, 114 and 116 in the corners of the plate 106 are of a diameter greater than that of the nuts 34 so that the housing 42 may be readily positioned against the plate 106 with the bolts 24, 26, 28, and 30 and nuts 34 thereon extending into or through the corner bores 110, 112, 114 and 116 of the vertical plate 106. The housing 42 is preferably attached to the vertical plate 106 by any suitable, readily actuatable coupling or latch arrangement. For example, the housing 42 may be attached to and detached from the vertical plate 106 by utilizing a bolt and wing nut arrangement generally shown at 118 and 120. By simply removing the wing nut 120, the housing 42 may be readily separated from the base 44 and the drive motor 90 for processing the cathode 18 to effect the removal of collected metal values thereon. With such an arrangement a further housing containing a clean cathode may be placed on the base 44 and the wing nut 120 replaced so that the metal recovery operation may continue substantially without interruption.

As pointed out above, the present invention provides a mechanism by which the formation of vortices in the circulating solution is prevented or inhibited so as to prevent the occurrence of dead spots with zero rotational direction in the solution which heretofore caused the metal to precipitate out of the circulating solution and collect in the center of the vortices. Further, the flow direction of the helically flowing stream within the volume 43 is controlled by the present invention to provide uniform liquid distribution of the metal-laden solution within the volume 43 to assure continuity and uniformity of contact between the central anode and the metal-laden solution, presence of metal ions at the cathode 18, to assure continuity and uniformity of contact between the central anode and the metal-laden solution, and also provide for the deposition of silver or other metal ions onto the cathode when the metal is in the solution at lower concentrations than heretofore useable.

In order to provide these and other features of the present invention, a baffle means 122 is disposed in the housing volume 43 at a location intermediate the cathode 18 and the anode 48. This baffle means 122 is preferably provided by a tubular or elongated open right-cylinder baffle 124 attached at one end thereof to the pump 82 by any suitable means such as a threaded coupling wherein the threads 126 on an annular end segment 127 of the baffle 124 engage mating threads in the pump body. When the baffle 124 is so attached to the pump 82 the elongated cylindrical baffle 124 is cantileveredly supported in the volume 43 by the pump body and provides for flow of liquid solution through the baffle 124 into the inlet 84 of the pump 82. The baffle 124 is positioned within the volume 43 so as to concentrically encompass a substantial portion of the length of the anode 48 with the distal end 130 of the baffle 122 being disposed in a location longitudinally spaced from the inside surface of the cover 20 a distance of about 1.75 to 2 inch for a housing 42 of the aforementioned dimensions. With the cylindrical baffle 124 so positioned in the housing 42, an annular passageway 132 is provided between the cylindrical baffle 124 and the external surface of the anode 48 for the passage of liquid solution through the annular passageway 132, over the anode 48 and into the pump 82 for circulation of the solution through the housing volume 43.

In accordance with the present invention, the cylindrical baffle means 122 is provided with a plurality of thoroughgoing bores or perforations 134 at circumferentially and longitudinally spaced apart locations. These perforations 134 extend tangentially at an angle to the radius of the baffle 124 through the side walls of the cylindrical baffle 124 and are also inclined at an angle to the longitudinal axis of the baffle towards the pump inlet 84. With these perforations so oriented, liquid solution in the volume 43 contacts the baffle means 122 and passes through the perforations 134 with the flow therethrough causing minimal disturbances or turbulence in the helically flowing solution in the volume 43. With a plurality of perforations 134 in the baffle 124, the annular passageway 132 as provided by the spacing between the inner walls of the baffle 124 and the outer surface of the anode 48, should provide a flow capacity which, when combined with the volume of flow through the perforations 134, corresponds to essentially the capacity of the pump 45 when operating at a preselected speed and capacity. Thus, the volume of the solution entering the annular passageway 132, as indicated by the arrows 135, is at a volume slightly less than that of the selected pump capacity so that the solution passing to the pump 45 through the annular passageway 132 will aspirate the flow of the solution through the perforations 134 along the length of the cylindrical baffle 124 as generally by the arrows 136. The angle at which the perforations 134 are inclined towards the pump inlet 84 is sufficient to assure that the solution passing through the annular passageway 132 will aspirate the solution through the perforations 134. An angle of inclination in the range of about 30 to 60 degrees, preferably about 45 degrees, is satisfactory for aspiration purposes.

As shown in FIGS. 1 and 2, the baffle 124 is provided with three longitudinally spaced apart rows of perforations 134 with four perforations 134 in each row. With a baffle 134 of the aforementioned size, the perforations 134 may be about 0.25 inch in diameter to provide the desired flow of solution through the perforations to inhibit the formation of vortices in the volume 43. However, it will appear clear that a greater or lesser number of perforations and/or rows of perforations may be used depending upon various structural parameters such as the size of the perforations, the volume of flow through the passageway 132, pump capacity, the size of the baffle, and the size of the annular passageway.

The bleeding-off of the solution through the perforations 134 at longitudinally spaced-apart locations along the outer surface of the baffle 124 prevents the formation of vortices in the solution within the volume 43. Further, by employing these perforations 134 along the length of the baffle 124, the helical flow pattern within the volume is maintained essentially uniform and in a constant direction so as to provide for the uniform distribution of the metal laden solution within the volume 43 to assure the presence of metal in a uniform manner at the cathode 18. Also, by providing such a uniform flow distribution within the volume 43, the plating solution may be depleted of metal values to a lower level than heretofore attainable. Still further, by ensuring the maintenance of plating solution within and filling the interior of the baffle, there is assured uniformity and continuity of the current density between the anode and cathode.

As mentioned above, the inlet 66 for the metal-containing solution from the processor 12 is disposed at a location in the cover 20 where the incoming liquid solution is primarily directed into the annular passageway 132 for facilitating the reception of the fresh liquid solution by the pump 82 after passing over the anode 48 for the helical distribution of the metal laden solution by the pump 82 throughout the volume 43 before the solution is discharged from the housing 42 through the outlet 74 in the cover 20.

As shown in FIG. 1, the housing 42 of the electrolytic metal recovery assembly is coupled to the processor 12 in a readily separable manner. This coupling arrangement may be provided by employing suitable coupling devices such as union-type couplings 141 and 142 in conduits 68 and 76 with on-off valves 144 and 146 positioned in the conduits 68 and 76 between the processor 12 and the couplings 141 and 142 to control the flow of solution from the processor when a housing 42 is removed from or placed on the base 44. The housing 42 is also provided with a valve arrangement wherein the flow from the housing 42 to and from the processor 12 can be controlled to permit removal of the housing 42 from the base 44. This valve arrangement may be provided by any suitable type valve such as simple valve disposed in the conduits 68 and 76 between the couplings 141 and 142 and the housing 42 or by employing a valve arrangement integral with the housing 42. For example, as shown in FIG. 1, a plastic mounting block 147 is attached to the outer surface of the cover 22 by any suitable arrangement such as by using the bolt 52 of the anode 48 for holding the block 147 in position. This mounting bloc 147 is provided with bores 148 and 150 which are respectively coupled to the inlet conduit 68 and the outlet conduit 76. The mounting block 147 is provided with rotary on-off valves 152 and 154 in the inlets 66 and outlets 74 respectively, and in registry with the bores 148 and 150 for cutting off the flow of the solution from within the housing 42 when it is desired to remove the housing 42 from the base 44. The handles 156 and 158 on valves 152 and 154 are used to rotate the valves for terminating or initiating flow of the solution into the housing 42 and from the housing 42 to the processor 12.

With the apparatus of the present coupled to the processor 12 for the recovery of metal values such as silver, the metal recovery assembly is preferably provided with a auxiliary power control as generally shown at 160 and couple to power supply 62 for controlling the density of the current at the cathode 18 and thereby effectively depleting the solution of silver values without encountering the problems associated with sulfiding as described in patentee's aforementioned patent.

With the solution from the processor 12 conveyed through the housing volume 43 for a suitable duration to provide an adequate buildup of silver on the internal wall surface of the cathode 18, or if a solution placed in the housing 42 in a batch-type operation is adequately stripped of metal, the current flow to the cathode 18 is stopped and the valves 144, 146, 152, and 154 are closed, the couplings 141 and 142 are disengaged so that the housing 42 can be removed from the base 44 and uncoupled from the drive motor 90 by simply removing the wing nut 120. The housing 42 with the solution therein can then be taken to a suitable location where the silver or other metal on the cathode 18 may be recovered by removing the cover 20 to gain access to the cathode 18. Before the bolts 32 and the cover 20 are removed for providing such access to the cathode 18, the solution in the housing is preferably drained from the volume 43 by utilizing a simple drain arrangement 164 provided by a passageway 165 in the end cover 22. A plug 166 is shown for terminating or initiating flow through the drain 164.

It will be seen that the present invention provides an improved electrolytic metal recovery apparatus wherein the electrolytic recovery unit or assembly may be readily separated from its supporting structure and drives for the removal of the recovered metal from the cathode. The present invention especially provides a mechanism by which the helically flow of the metal-laden solution within the housing volume is controlled in order to obviate the formation of vortices in the solution as well as promoting uniform flow characteristics in the solution for significantly enhancing the operational efficiency of the metal recovery operation.

What is claimed is:

1. In a metal recovery system having an electrolytic cell for separating and collecting metal from a metal-containing solution comprising:

housing means;

elongated tubular cathode means within said housing means;

elongated anode means disposed within said housing means at a location radially inwardly spaced from said cathode means;

pump means for circulating a metal-containing solution within said housing means along a helical flow path; and elongated anode means disposed within said housing means at a location radially inwardly spaced from said cathode means;

pump means for circulating a metal-containing solution within said housing means along a helical flow path; and elongated baffle means disposed intermediate said anode means and said cathode means and contractable by the circulating metal-containing solution for inhibiting the formation of vortices in the circulating solution, wherein said baffle means are of an annular configuration and are disposed about the elongated anode means over a substantial length thereof in a spaced relationship thereto for defining an open-ended annular passageway therebetween, wherein said baffle means has a plurality of throughgoing perforations therein at locations intermediate opposite ends thereof, wherein inlet means for said pump means are in registry with said passageway at one end of the baffle means for drawing metal-containing solution there into through both the open end of the passageway remote to said one end of the baffle means and said perforations.

2. In a metal recovery system as claimed in claim 1, wherein first and second cover means are disposed at opposite ends of said cathode means for enclosing said housing means, wherein said anode means are supported by the first cover means and longitudinally extend into said housing means to a location spaced from the second cover means, and wherein said baffle means are supported by the second cover means.

3. In a metal recovery system as claimed in claim 2, wherein said pump means are disposed within said housing means at a location intermediate said baffle means and said second cover means, and wherein elongated outlet means are coupled to said pump means and are disposed in said housing means for circulating through said housing means metal-containing solution received in said pump means through said inlet means, and wherein said outlet means are inclined at a angle sufficient to cause the metal-containing solution discharging therefrom to flow along a helical flow path throughout the longitudinal length of and in close proximity to said cathode means.

4. A metal recovery system as claimed in claim 3, wherein support means carry said housing means, wherein drive means for said pump means are disposed external to said housing means and are carried by said support means, wherein said drive means are coupled to said pump means by separatable coupling means, and wherein selectively engagable latch means connect said housing means to said support means.

5. A metal recovery system as claimed in claim 4, wherein solution inlet means and outlet means are disposed in said first cover means, wherein the solution inlet means in the first cover means are in registry with said passageway means, wherein metal-containing solution supply means are coupled by conduit means to said solution inlet means and outlet means in the first cover means, wherein selectively connectable coupling means are in said conduit means, and wherein valve means are disposed in said conduit means on opposite sides of said selectively connectable coupling means.

6. A metal recovery system as claimed in claim 4, wherein said housing means are carried on said support means with said cathode means and said anode means being horizontally oriented.

7. In a metal recovery unit having an electrolytic cell for recovering metal from a solution containing metal values, said electrolytic cell comprising:

an elongated tubular cathode open at opposite longitudinal ends thereof;

first and second cover means at each end of the tubular cathode for defining an enclosed volume within the tubular cathode for retaining said solution;

an elongated cylindrical anode attached at one end thereof to the first cover means and concentrically disposed within the tubular cathode with said anode longitudinally extending within the tubular cathode to a location spaced from the second cover means;

pump means for pumping the solution through said volume;

pump inlet means in registry with said pump means and disposed within said volume adjacent to said second cover means at a location longitudinally spaced from and substantially coaxial with said anode for receiving said solution;

pump outlet means in registry with said pump means and disposed at an angle to the tubular cathode for discharging said solution from the pump means and circulating said solution within said volume along a helically oriented flow path towards the first cover means; and perforated hollow cylindrical baffle means supported at one end thereof by the second cover means in a location within said volume coaxial with said pump inlet means and disposed concentrically about a substantial length of said anode in a spaced relationship thereto for contacting and receiving therein through an open end thereof opposite said one end and perforations therein solution circulated within said volume by said pump means and conveying the received solution to said pump inlet means, whereby the contacting of the helically flowing solution with the baffle means inhibits the formation of vortices within the circulating solution and promotes uniform distribution of the circulating solution within said volume.

8. In a metal recovery unit as claimed in claim 7, wherein solution-containing reservoir means are located externally to the electrolytic cell, and wherein solution inlet means and outlet means are in registry with said volume and said reservoir means for conveying liquid containing metal values from said reservoir means into said volume through said solution inlet means to be processed in the electrolytic cell and for conveying processed liquid from said volume to the reservoir means through said solution outlet means.

9. In a metal recovery unit as claimed in claim 8, wherein said solution inlet means and said solution outlet means are disposed in said first cover means, wherein conduit means couple the solution inlet means and the solution outlet means to said reservoir means, wherein valve means are in said conduit means for controlling the flow of solution therethrough, and wherein connecting means are disposed intermediate valve means in the conduit means for selectively coupling or uncoupling the electrolytic cell from said reservoir means.

10. In a metal recovery unit as claimed in claim 7, wherein said pump means are disposed in said volume and are centrally supported on said second cover means, and wherein said baffle means are supported by said pump means and encompass said pump inlet means.

11. In a metal recovery unit as claimed in claim 10, wherein said baffle means and said pump means are substantially formed of electrically non-conducting material.

12. In a metal recovery unit as claimed in claim 7, wherein the perforations in said baffle means are provided by a plurality of perforations extending through the baffle means with said perforations being tangentially oriented in the baffle means for receiving therein the helically flowing solution contacting the baffle means.

13. In a metal recovery unit as claimed in claim 12, wherein each of said plurality of perforations extends through the baffle means at a sufficient angle to the longitudinal axis of the baffle means for effecting aspiration of the solution through the perforations by the solution flowing into said baffle means through said open end thereof.

14. In a metal recovery unit as claimed in claim 13, wherein the angle to the longitudinal axis of the baffle means is in the range of about 30 to 60 degrees.

15. In a metal recovery unit as claimed in claim 13, wherein said plurality of perforations is provided by a plurality of rows of perforations longitudinally spaced apart from one another along the longitudinal length of said baffle means.

16. In a metal recovery unit as claimed in claim 15, wherein each of said plurality of rows contains a plurality of perforations circumferentially spaced apart from one another.

17. In a metal recovery unit as claimed in claim 16, wherein the open end of the baffle means is longitudinally spaced from the first cover means and radially spaced from said anode means sufficient distances to provide an adequate volume of flow of solution through the open end of baffle means to the pump inlet means to aspirate flow of solution through the perforations in the baffle means.

18. In a metal recovery unit as claimed in claim 7, wherein drive means external to said electrolytic cell are coupled to said pump means for driving said pump means to provide the helical flow of the solution in said volume.

19. In a metal recovery unit as claimed in claim 18, wherein said drive means are coupled to said pump means by a magnetically actuated coupling.

20. In a metal recovery unit as claimed in claim 7, wherein the pump outlet means comprises an elongated arcuate conduit tangentially extending from the pump means with an open end thereof remote to the pump means being disposed at an angle the longitudinal length of the cathode for directing the solution discharged through the conduit in the helically oriented flow path.

* * * * *

UNITED STATES PATENT AND TRADEMARK OFFICE

CERTIFICATE OF CORRECTION

PATENT NO. : 5,102,522

DATED : April 7, 1992

INVENTOR(S) : James Rivers

It is certified that error appears in the above-identified patent and that said Letters Patent is hereby corrected as shown below:

Column 1, line 46

Delete "into" and insert --onto-- therefor.

Column 1, line 54

Delete "practive" and insert --practice-- therefor.

Column 9, line 39

Delete "bloc" and insert --block-- therefor.

Signed and Sealed this

Eighth Day of June, 1993

*Attest:*

Michael K. Kirk

MICHAEL K. KIRK

*Attesting Officer*

*Acting Commissioner of Patents and Trademarks*